United States Patent [19]

Brown

[11] Patent Number: 5,007,594

[45] Date of Patent: Apr. 16, 1991

[54] PREPARATION OF WOUND GOLF BALL CORES

[75] Inventor: Robert A. Brown, Mattapoisett, Mass.

[73] Assignee: Acushnet Company, New Bedford, Mass.

[21] Appl. No.: 333,985

[22] Filed: Apr. 5, 1989

Related U.S. Application Data

[62] Division of Ser. No. 53,948, May 26, 1987, Pat. No. 4,846,910.

[51] Int. Cl.[5] ..... A63B 47/00; B65H 54/64

[52] U.S. Cl. ..... 242/3; 156/170

[58] Field of Search ..... 242/3, 2; 156/170

[56] References Cited

U.S. PATENT DOCUMENTS

| | | | |
|---|---|---|---|
| 740,348 | 9/1903 | Worthington | 242/3 |
| 1,880,264 | 10/1932 | McChesney | 242/3 |
| 2,136,195 | 11/1938 | Oldham | 242/3 |
| 2,161,546 | 6/1939 | Honig . | |
| 2,278,381 | 3/1942 | Reichard . | |
| 2,668,016 | 2/1954 | Huse | 242/3 |
| 2,995,311 | 8/1961 | Holman | 242/3 |
| 3,781,158 | 3/1975 | Puleo | 242/3 |
| 4,483,489 | 11/1984 | Knecht | 242/2 |
| 4,846,910 | 7/1989 | Brown | 242/3 X |

*Primary Examiner*—Katherine Matecki

*Attorney, Agent, or Firm*—Lucas & Just

[57] ABSTRACT

An automatic machine and method for preparing a wound core of a golf ball. The machine has a plurality of winding stations services by one mechanical arm. The winding station has a cooling tower for holding frozen centers, a winding machine and tension device for performing the actual winding operation and an exit chute for wound cores. The specific steps for preparing the core are disclosed.

11 Claims, 9 Drawing Sheets

PREPARATION OF WOUND GOLF BALL CORES

This is a division of application Ser. No. 053,948, filed May 26, 1987, now U.S. Pat. No. 4,846,910 dated July 11, 1989

This invention relates to golf balls and more particularly to an apparatus and method for automatically preparing a wound golf ball core.

Golf balls are generally made by molding a cover about a core which is either solid or wound. Wound cores are prepared by winding an elastic thread about a frozen center. The frozen center is made from a solid rubber ball or a hollow rubber shell containing liquid which is frozen to form a small hard sphere. The thread is generally made from an elastic material.

Presently, all wound cores are prepared in a manual operation in which an individual operator ties the bitter end of a thread supply onto a frozen center and places the frozen center into a winding machine. The machine then winds the thread around the center to a predetermined thickness. The operator then cuts the thread, ties the thread onto the wound core, attaches the bitter end of the thread supply to a new center and loads the new center into the winding machine to start the process over again. This is a repetitive process.

A machine and method for automatically preparing a wound golf ball core has now been discovered. The present invention eliminates the need for an operator to supply frozen centers to individual winding machines, tying the thread onto the center removing the finished wound cores from the winding machine and tying the thread onto the wound core.

Broadly, the present invention obtains a frozen center from a storage container, secures the bitter end of a thread supply to the center, places the center into a winding machine and removes a finished wound core from the winding machine to start the process again.

More specifically, the present invention has a mechanical arm servicing a plurality of winding stations. Each winding station has a cooling tower, a winding machine and a wound core exit chute. The cooling tower holds frozen centers and maintains the centers in their frozen state. The winding machine has a thread supply and a means for winding the thread about the center which includes a means to maintain tension on the thread during winding operations. The exit chute is used to deposit the finished wound cores and to conduct the finished wound cores to a finished wound core storage bin.

The mechanical arm is equipped with a mechanical hand which performs the various tying operations of the thread on the center and core and which, in general, manipulates the center and core.

More specifically, a signal is sent from the winding station to the mechanical arm once the core has reached its predetermined size. At this point, the winding machine has ceased winding. After the signal has been received by the arm, the arm moves to that winding station and the hand removes the wound core from the winding machine. The hand then proceeds to tie and cut the thread so that the wound core is no longer attached to the thread supply while simultaneously maintaining control of the bitter end of the thread supply. Next, the wound core is deposited into the exit chute and the arm moves the hand to the cooling tower where the hand obtains a new frozen center to which it secures the bitter end of the thread. Then, the new center is placed into the winding machine. The thread tension is reduced by about 50% and the winding operation is started. Just after the winding operation is started, the tension on the thread comes back on to full force. Preferably the tension comes back on about 2 to about 4 seconds after winding starts again.

Also, preferably, the center is held in the cooling tower until the hand removes it from the tower. This insures that the center stays frozen.

Also, preferably, a heat source is used to sever the wound core from the thread supply. This prevents pulling of the thread which is generally accompanied with a knife-like severing operation.

Preferably, the tying operation on both the center and the core are not accomplished by the same repetitive steps performed by the hand in each case. More specifically, for tying the thread onto the finished core, the hand is equipped with fingers that pick up the thread and hold the thread out, away from the core. The hand makes a few turns with the thread out, away from the core such that the thread is wound onto the fingers. Next, the thread is wound about the core itself. Finally, the fingers release the thread which they held, causing the thread held by the fingers to overlap the thread already wrapped around the core. Due to the elastic nature of the thread and this overlapping arrangement of the thread on the core, the thread is secured to the core. The thread is secured to the center by winding the thread about the center, dropping the winding machine's head wheel down onto the center which forces the center onto the winding machine's endless belt, and then dropping the thread off of the fingers while simultaneously starting the winding operations.

These and other aspects of the present invention may be further understood from the following detailed description.

Figure 1:
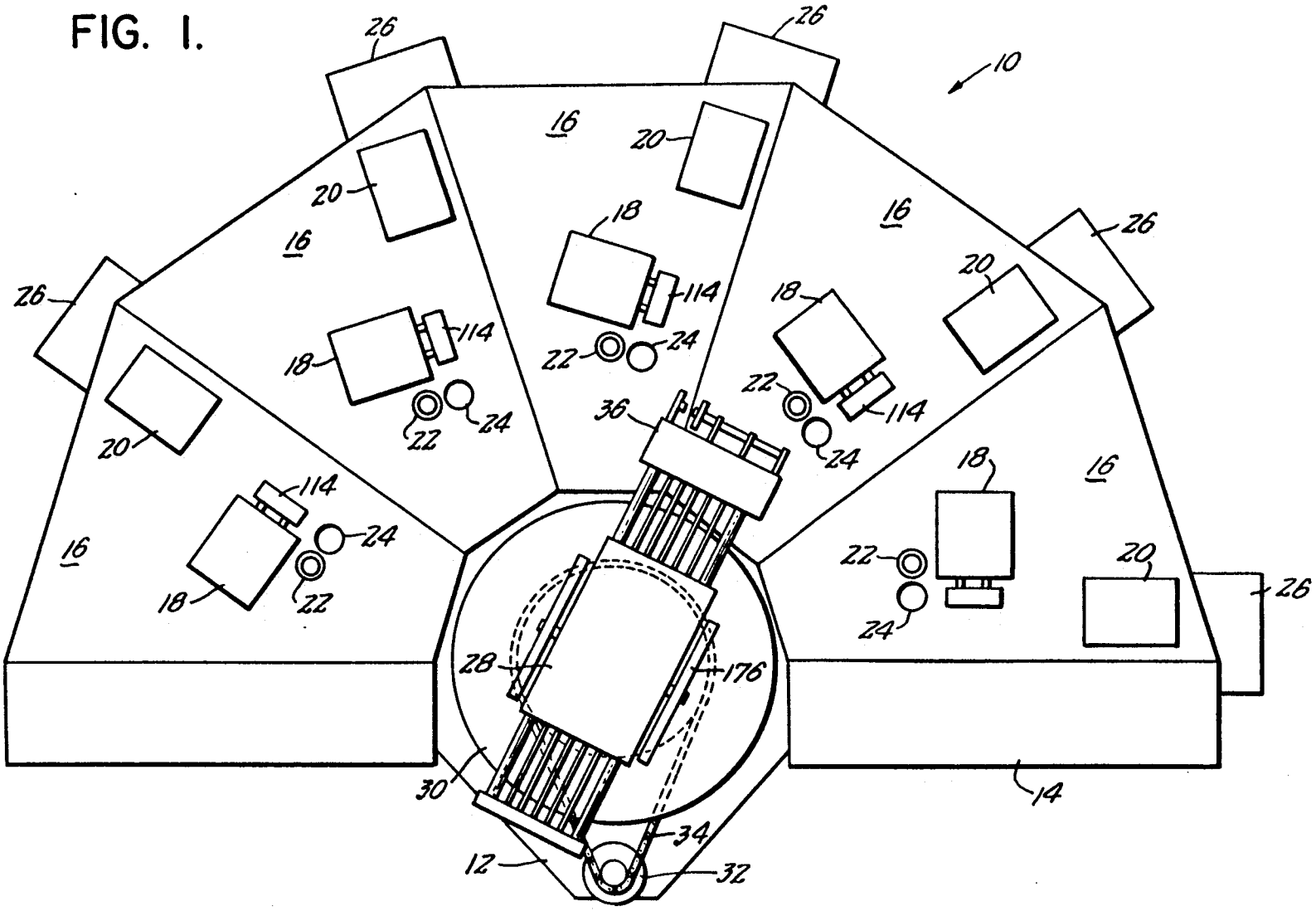
FIG. 1 illustrates an overview of a preferred embodiment of the present invention.

FIG. 1 illustrates an overview of a preferred embodiment of the present invention. Semicircular table 10 has removable inner table 12 and stationary outer table 14.

Stationary outer table 14 has five winding stations 16. Each winding station 16 has winding machine 18, thread tension device 20, cooling tower 22, wound core exit chute 24 and thread supply bin 26. Exit chute 24 is connected to a wound core storage bin, not shown. The finished wound cores are removed from the wound core storage bin for further processing.

Removable inner table 12 has mechanical arm 28 which is mounted on rotating circular table 30. Motor 32 is connected to and provides movement for circular table 30 by means of drive belt 34. Mechanical arm 28 is equipped with mechanical hand 36. Mechanical arm 28 and mechanical hand 36 move between each winding station 16 and between respective winding machine 18, cooling tower 22, and wound core exit chute 24 for each winding station 16. The removability of inner table 12 allows for replacement and repair of arm 28.

Figure 2:
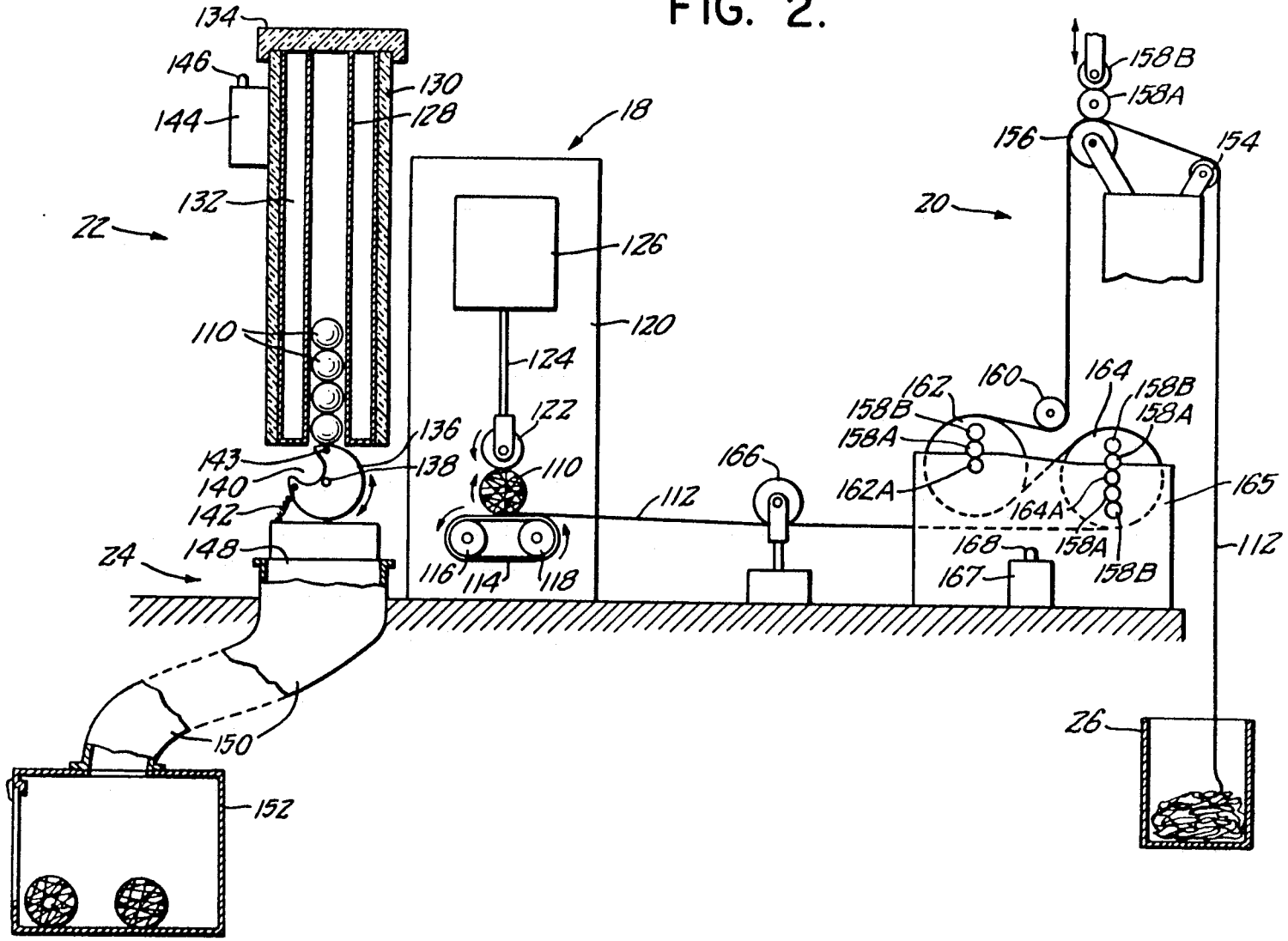
FIG. 2 illustrates a preferred embodiment of the winding station.

FIG. 2 illustrates a side view of a preferred embodiment of winding station 16 with winding machine 18, thread tension device 20, cooling tower 22, and wound core exit chute 24.

Turning to winding machine 18, frozen center 110 has elastic thread 112 partially wound around it. Center 110 rests on endless belt 114. Belt 114 is driven by drive wheel 118 and supported by following wheel 116. Drive wheel 118 is channeled as shown in FIGS. 6–9. This channeling causes belt 114 to be slightly fluted during winding operations which in turn helps maintain center 110 on belt 114 during such operations. Wheels 116 and 118 are supported by axles from housing 120. Housing 120 also provides housing for a drive motor, not shown, for drive wheel 118. Winding head wheel 122 rotates freely while thread 112 is wound onto center 110. As the amount of thread 112 wound around center 110 increases, head wheel 122 moves upward which in turn raises shaft 124. Shaft 124 passes through sensing and lifting station 126 which is mounted on the side of housing 120. When sensing and lifting station 126 senses that center 110 has obtained the size of a finished wound core, sensing and lifting station 126 signals the motor of drive wheel 118 to stop and signals mechanical arm 28 that the winding operation at that station 16 has finished. Sensing and lifting station 126 is also capable of lifting head wheel 122, via shaft 124, off of the finished wound core when mechanical hand 36 picks up the core and of pushing new centers held by hand 36 down onto belt 114 at the start of the winding operation. The manipulations performed by hand 36 will be given in more detail below.

Cooling tower 22 has inner well 128 which is concentric with outer well 130. Between inner well 128 and outer well 130 is a space 132 into which a cooling medium is placed which maintains center 110 in a frozen state. Any cooling medium can be used, preferably dry ice is used. Center 110 is loaded into inner well 128 while dry ice is loaded into space 132 and insulated cap 134 is placed over tower 22.

Feed device 136 rotates both clockwise and counter-clockwise on axis 138. Device 136 is shown in a rest position in FIG. 2. When a new center is needed for winding machine 18, hand 36 causes device 136 to rotate clockwise by pushing on pin 143 until opening 140 in device 136 presents itself fully to inner well 128. Gravity causes new center 110 to drop down into opening 140. Opening 140 is large enough to accommodate one center. Then hand 36 is withdrawn from device 136 and device 136, under the force of spring 142, rotates counter-clockwise back to the rest position. This action allows a new center to be withdrawn from inner well 128 while maintaining other centers inside cooling tower 22. Hand 36 then removes center 110 from opening 140 and moves center 110 to winding station 18.

Attached to tower 22 is sensing unit 144 which senses when inner well 128 is close to or empty of centers 110. When sensor 144 senses that more centers are needed in inner well 128, signal light 146 is illuminated. This tells an operator that more frozen centers 110 are needed. Additionally, sensor unit 144 can be used to sense the temperature of inner well 128 such that if the temperature in inner well 128 rises above an acceptable level, signal light 146 is illuminated to inform the operator of the temperature rise. Device 136 of cooling tower 22 and belt 114 of winding machine 18 are at such a height that hand 36 can reach both without adjusting its vertical height. When placing a new center on belt 114, hand 36 holds center 110 just above belt 114 and head wheel 122 pushes center 110 down onto belt 114. Hand 36 follows this downward movement. Arm 28 is spring mounted such that it is able to follow the movement of hand 36.

Wound core exit chute 24 has mouth 148 and duct 150 which connects to wound core storage bin 152. When winding is finished, arm 28 removes the wound core from winding machine 18 ties off thread 112 onto the wound core and drops the wound core into mouth 148 which in turn conducts the wound core down duct 150 to wound core storage bin 152. The wound cores are removed from the storage bin for further processing.

Turning now to thread tension device 20, as center 110 turns on endless belt 114, it draws thread 112 through tension device 20 from supply bin 26. From the supply bin 26, the thread 112 first passes over an idler roll 154 and then to a tension wheel 156. The tension wheel 156 preferably has a groove (not shown) in which the thread travels. The groove is of less depth than the thickness of the thread so that tension apparatus 158 can apply nip-like pressure on the thread. Tension apparatus 158 comprises a rubber tension wheel 158A and a metal tension wheel 158B. Metal wheel 158B is biased for up and down movement. When it is up, no tension is applied to the thread. During normal winding operations, metal wheel 158B is in the down position and causes rubber wheel 158A to engage the thread. The rubber wheel 158A in combination with wheel 156 essentially acts like a nip roll with respect to the thread 112.

From this initial tension apparatus 158, the thread 112 travels around idler roll 160 to low tension wheel 162. Low tension wheel 162 has tension wheels 158A and 158B which are the same as in tensioning apparatus 158. In this case, however, the tension wheels 158A and 158B bear against axle 162A of low tension wheel 162. It will be appreciated that the pressure which is applied to axle 162A by tension wheels 158A and 158B will directly affect the degree of stretch of the elastic thread 112 as it is wound onto center 110. While tension will be increased between tension wheel 162 and center 110, the rate of feed of thread 112 will be the same since that is solely dependent on the rate of feed through tension wheel 156.

After low tension wheel 162, the thread passes over high tension wheel 164. In order to be able to exert sufficient force on the axle 164A of high tension wheel 164, there are two pairs of tension rollers 158A and 158B. Low tension wheel 162 provides about 50% of the tension to thread 112 while high tension wheel 164 provides the remaining 50% of tension to thread 112. Low tension wheel 162 provides thread 112 with tension throughout all phases while high tension wheel 164 is disengaged from thread 112 just prior to the start of the winding operation and re-engages thread 112 to bring the tension up to full tension about two to four seconds into the winding operations. Both wheels 162 and 164 reside in housing 165 which controls the movements of high tension wheel 164. As thread 112 leaves housing 165, it travels under tension sensing wheel 166 which rides on thread 112. When thread 112 breaks, wheel 166 falls and signals sensing unit 167 causing light 168 to illuminate. When light 168 is on, the operator knows that thread 112 has broken or thread storage bin 26 is empty and must be attended to.

Figure 3:
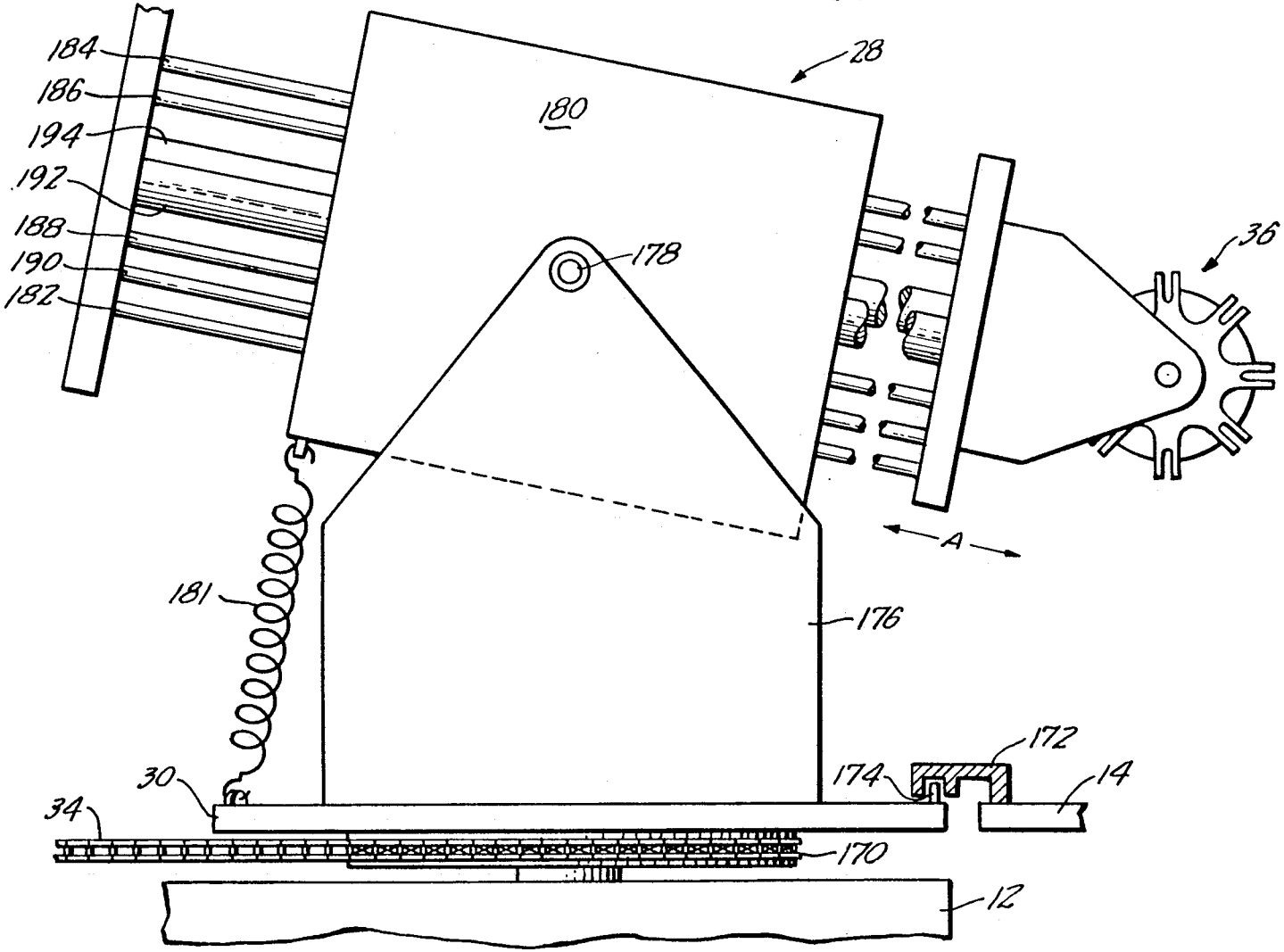
FIG. 3 illustrates a preferred embodiment of the mechanical arm.

FIG. 3 illustrates a side view of mechanical arm 28 and hand 36.

Drive belt 34 is illustrated as a chain similar to a bicycle chain connected to circular table 30 by means of sprocket 170. Drive belt 34 is driven by motor 32, shown in FIG. 1. The movement of arm 28 between each winding station 16 and between cooling tower 22 and winding machine 18 for each respective winding station 16 is facilitated through motor 32.

Motor 32 can move arm 28 both clockwise and counterclockwise. Prior to moving arm 28 to another winding station, motor 32 moves arm 28 to home point of reference for the motor axis. Additionally, each winding station has home plate 172 which is receptive to sensor 174 of circular table 30. The position of a specific winding station 16 is sensed by sensor 174. Thus, when arm 28 receives a signal from a specific winding station 16 that it has finished winding, arm 28 moves to the home point of reference for its axis and then moves to that station. Sensor 174 tells arm 28 exactly where to stop with respect to winding machine 18 of that specific winding station 16. Because each cooling tower 22, winding machine 18 and exit chute 24 are identically located in winding station 16, the exact number of degrees of movement for arm 28 to its respective cooling tower 22, winding machine 18 and exit chute 24 is known by arm 28.

Arm 28 is mounted on frame 176 which is mounted on rotating circular table 30. Arm 28 is able to pivot about axis 178. Arm 28 has housing 180 which is pivotally mounted to frame 176.

Arm 28 is angled downward as shown in FIG. 3. The angle is such that when hand 36 is extended forward, it will contact both feed device 136 to allow it to pick up new center 110 and to contact belt 114 to allow it to pick up a wound core and drop off center 110 on belt 114. When hand 36 comes in with new center 110 to place it on belt 114, hand 36 holds center 110 just above belt 114. Head wheel 122 presses center 110 down onto belt 114. Hand 36 is able to follow because spring 181 allows hand 36 and arm 28 to move vertically downward. When hand 36 releases center 110, arm 28 and hand 36 spring back to their original angle under the force of spring 181. Passing through housing 180 are five motor axes which provide movement for hand 36. These axes are arm extension axis 182, spinner axis 184, collet axis 186, finger axis 188 and gripper axis 190. Stabilizer bars 192 and 194 help to stabilize hand 34 during movement. Each motor axis 182–190 is connected to a drive motor which resides in frame 176 and is preprogrammed to turn on and off and provide power to the various motor axes 182–190 during manipulation operations performed by hand 36. As with motor 32, each motor axis 182–190 has a home point of reference whence it returns prior to performing a set of manipulations. Arm extension axis 182 moves hand 36 forwards and backwards as illustrated by double headed arrow A in FIG. 3. The specific functions of each motor axis 182–190 will be described in more detail below.

Figure 4:
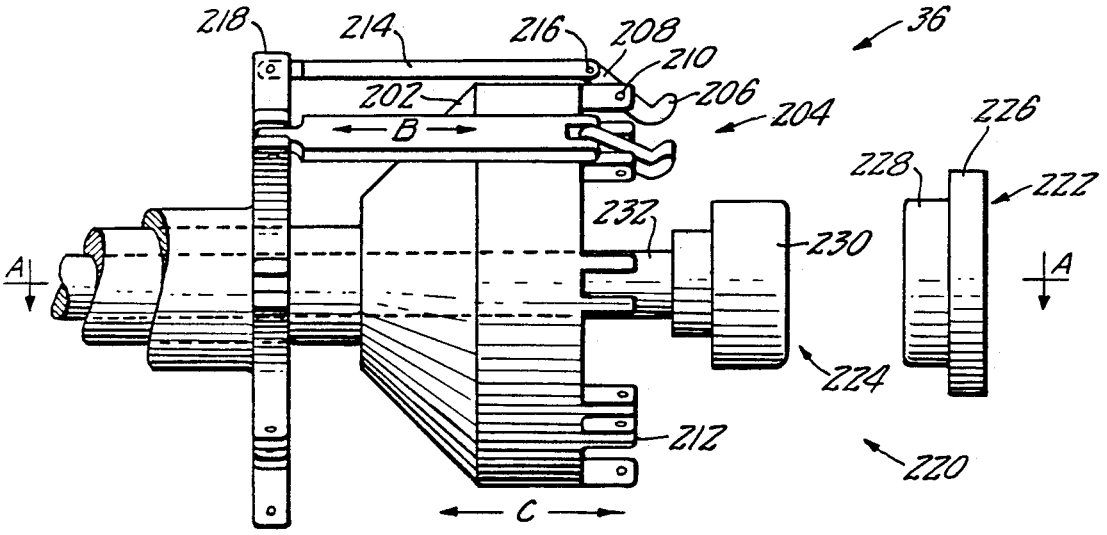
FIG. 4 illustrates a front view of the hand.
Figure 5:
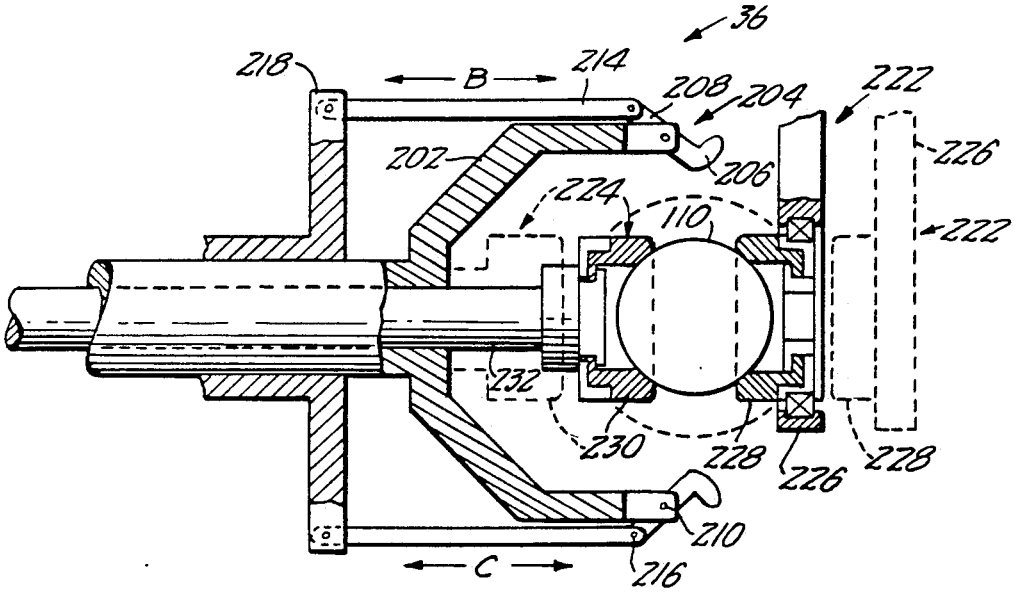
FIG. 5 illustrates a cross-sectional view of the hand.
Figure 8:
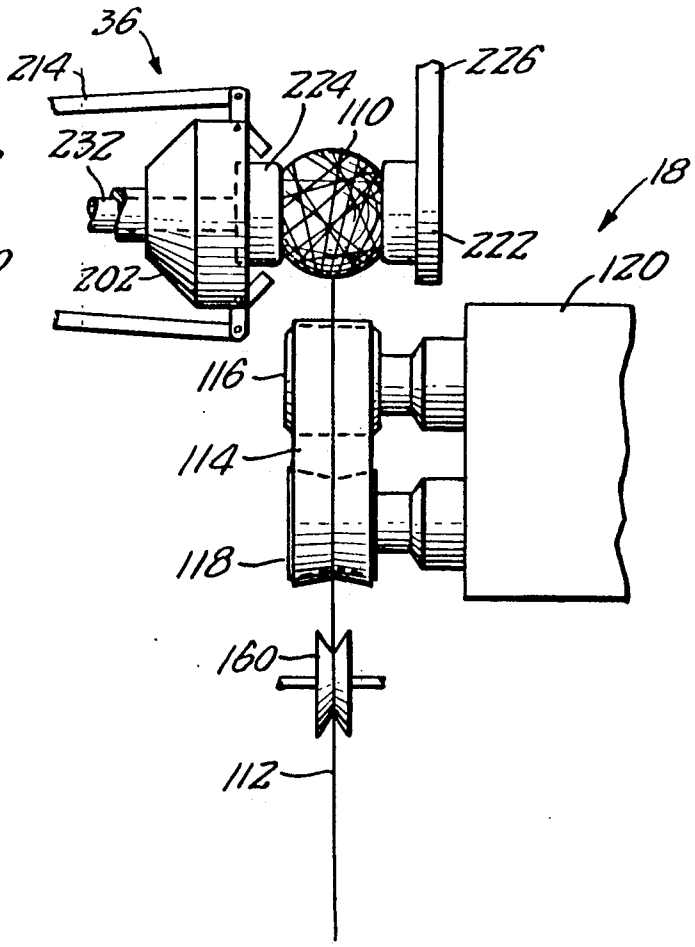
FIGS. 6–9 illustrate a preferred embodiment of the hand operations of the present invention.

FIG. 4 is a front view of hand 36, while FIG. 5 is a cross-sectional view of hand 36 taken along line A—A of FIG. 4.

Hand 36 has collet 202 and a plurality of fingers 204. Fingers 204 is a "J" shaped hook with short hooked section 206 and back section 208. Back section 208 is pivotally mounted by pin 210 in forked section 212 of collet 202. Link 214 is pivotally connected to back section 208 by pin 216. Link 214 is fixed onto plate 218. Plate 218 is connected to finger axis 188 such that link 214 moves back and forth as illustrated by double headed arrow B in FIGS. 4 and 5. This movement causes fingers 204 to move. The exact movement of fingers 204 to perform the present invention is detailed below.

Collet 202 has a plurality of forked sections 212 and a plurality of fingers 204, preferably 8. Collet 202 is connected to collet axis 186 such that collet 202 moves back and forth as illustrated by double headed arrow C in FIGS. 4 and 5. The movement of collet 202 is coordinated with the movement of fingers 204 such that collet 202 moves backwards and forwards without affecting the relative position of fingers 204 with respect to collet 202. Thus, fingers 204 move with collet 202. The exact movements of collet 202 with respect to the performance of the present invention is detailed below.

Gripper 220 has passive grip 222 and active grip 224. Passive grip 222 has arm 226 on which freely rotating hub 228 is mounted. As illustated in FIG. 5, hub 228 is hollow to accommodate frozen center 110 and a finished wound center. Active grip 224 has hub 230 which is fixed on the end of shaft 232. Hub 230 is similar to hub 228 as illustrated. Arm 226 and shaft 232 are connected to gripper axis 190 such that both active and passive grips 222 and 224 are able to open and close around a center/core as shown in FIG. 5.

Active grip 224, collet 202, fingers 204, link 214 and plate 218 are connected to spinner axis 184 and are able to spin in unison when spinner axis 184 is engaged. During such spinner action when the center/core is held in active and passive grips 222 and 224, hub 228 of passive grip 222 follows the movement of the center/core while it is spun. Arm 226 remains stationary.

FIGS. 6–18 detail the steps performed by arm 28 of a preferred embodiment of the present invention. For simplicity in FIGS. 6–18, fingers 204 are shown as an "L" not a hooked "J".

Figure 6:
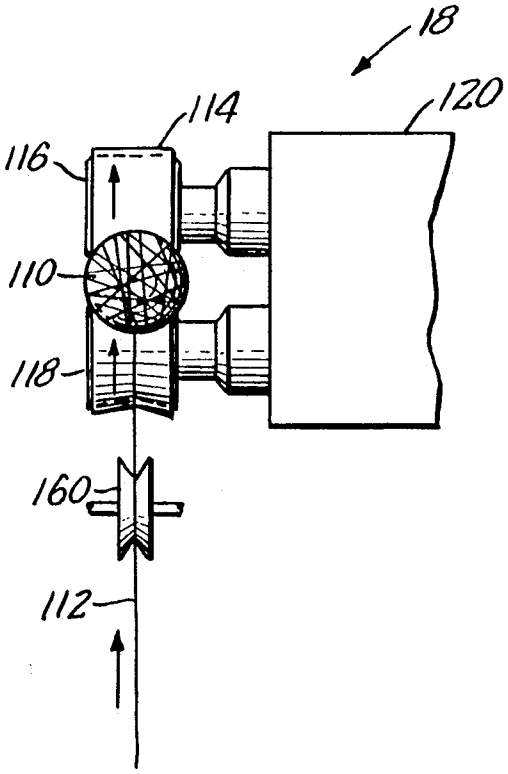

FIG. 6 illustrates a finished wound core in winding machine 18. Head wheel 122 is not shown. As the windings on center 110 reached a predetermined thickness, head wheel 122 was pushed upward which in turn caused shaft 124 to rise and trigger sensing and lifting station 126 to send a signal to arm 28 that the winding operation at that winding machine was finished and to signal drive wheel 116 to stop. Arm 28 rotates to its reference point and then to home plate 172 of that winding station. The first step is to remove the wound core from the winding machine and tie off the end of the thread as it comes from the thread supply. This step is illustrated in FIGS. 7–11.

Figure 7:
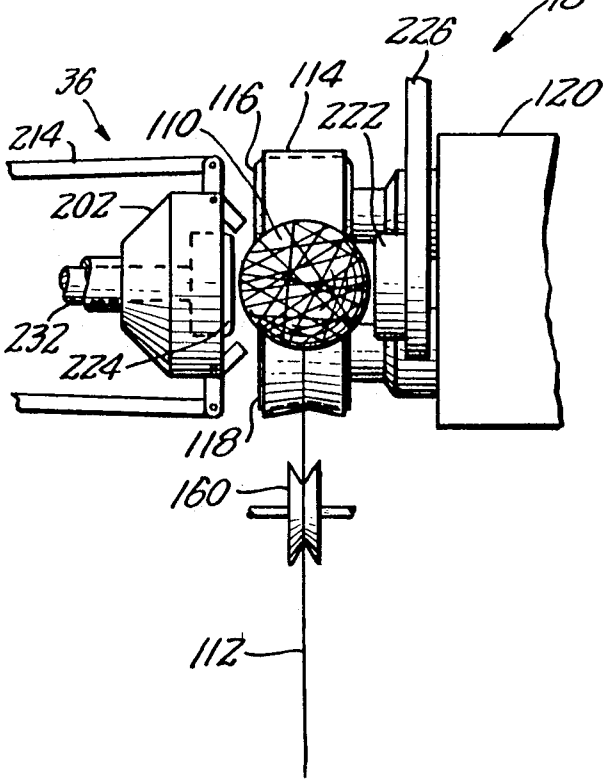

Once arm 28 is positioned opposite winding station 18, hand 36 is extended by means of extension arm axis 182 such that wound center 110 is flanked by passive and active grips 222, 224 as illustrated in FIG. 7.

Next, passive and active grips 222 and 224 are firmly closed around wound center 110 by means of gripper axis 190. Then, sensing and lifting station 126 lift head wheel 122 off of wound center 110.

Then, hand 36 moves wound center 110 off of drive belt 114. This is done by means of arm extension axis 182. See FIG. 8.

Figure 9:
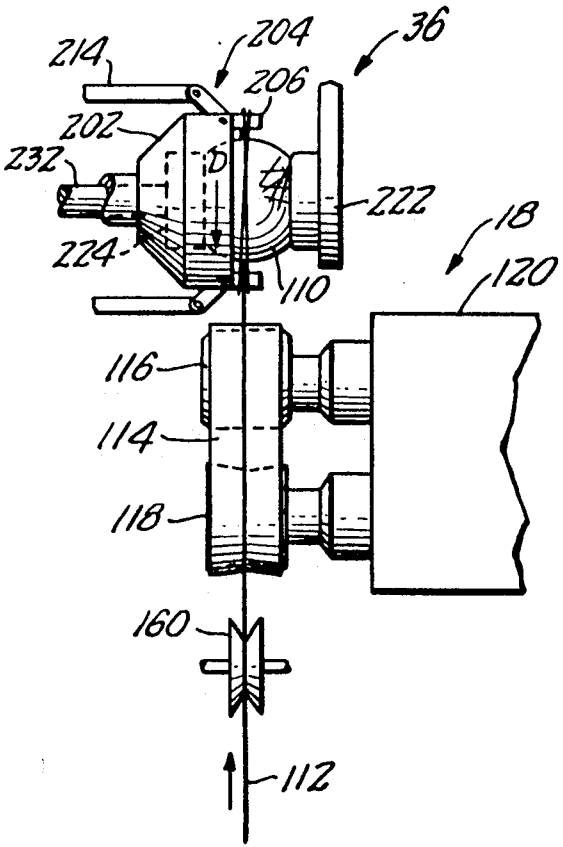

Collet 202 is then moved towards wound center 110 by means of collet axis 186 and fingers 204 are extended such that short section 206 of fingers 204 extend through a vertical plane of thread 112 as shown in FIG. 9. Fingers 204 are moved by means of finger axis 188.

Then, spinner axis 184 is engaged such that collet 202, active grip 224, fingers 204 and wound center 110 are spun in a direction as shown by arrow D in FIG. 9. Hub 228 of passive grip 222 follows. This action causes thread 112 to be wound around short section 206 of fingers 204. Only a few rotations of the center is needed, preferably 2⅜ rotations, see FIG. 9.

Figure 10:
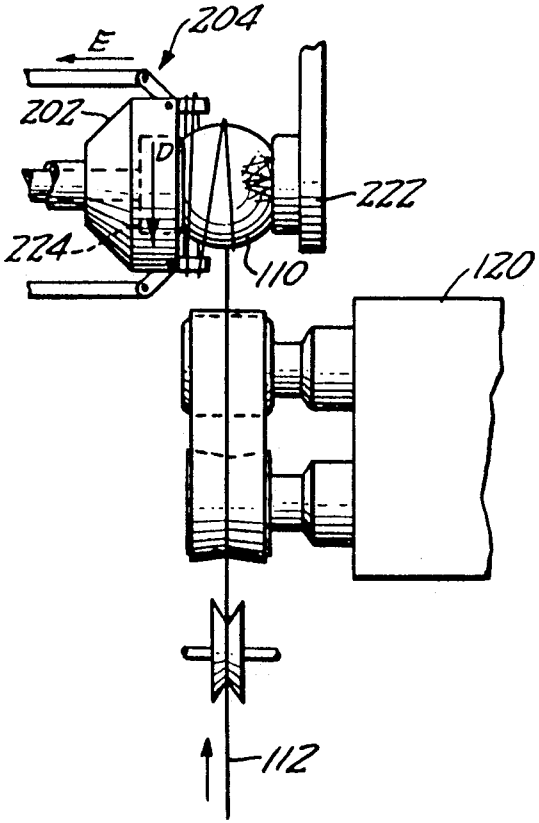

Next, collet 202 by means of collet axis 186 is moved away from wound center 110 so that fingers 204 are no longer in the vertical plane of thread 112 as shown in FIG. 10. Collet 202 is preferably moved to an intermediate position as shown in FIG. 10. Intermediate means in-between the position of collet 202 in FIG. 8 and the position of collet 202 in FIG. 9.

Next, spinner axis 184 is again engaged such that collet 202, active grip 224, fingers 204 and wound center 110 are spun in the direction as shown by arrow D in FIG. 10. Again, hub 228 of passive grip 222 follows. This action causes thread 112 to be wound around wound center 110 a shown in FIG. 10. Preferably this winding action is such that thread 112 is wound 1⅓ times around wound center 110. Prior to spinning, arm 28 moves slightly in the direction of arrow E in FIG. 10. This movement causes the vertical center line of center 110 to be to the collet side of the vertical plane of thread 112 thus causing thread 112 to catch center 110 on the passive gripper side and allow thread 112 to stay wound around center 110. Arm 28 moves the vertical center line of center 110 back into the vertical plane of thread 112 after the thread is caught.

Figure 11:
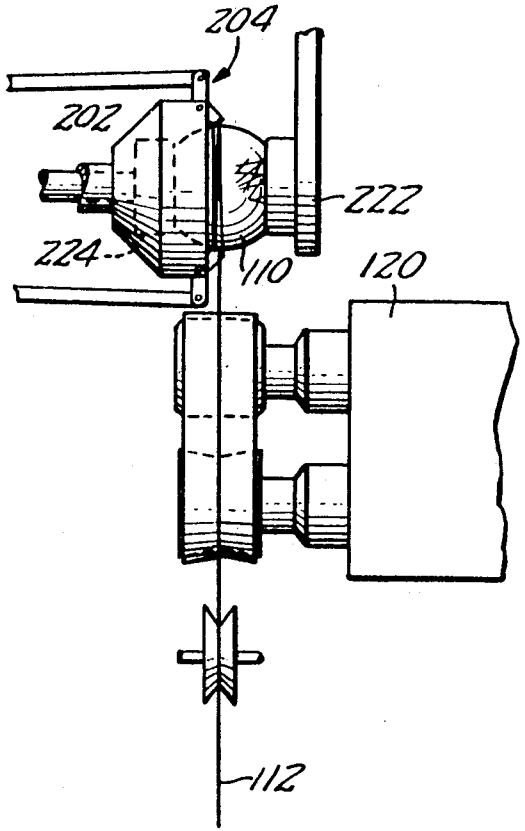

The next movement of hand 36 is moving collet 202 back to its position as in FIG. 9 and dropping thread 112 wound around fingers 204. The dropping action is done by moving link 214 forward which causes short section 206 to tilt towards wound center 110. See FIG. 11. This causes thread 112 to slide off short section 206 and close around wound center 110 as shown in FIG. 11.

This completes the tying portion of the process performed by hand 36 on the wound center 110. Now the hand must sever the connection between wound center 110 and thread supply 26 such that a new bitter end of thread supply 26 is available for a new center. This is illustrated in FIGS. 12–13.

Figure 12:
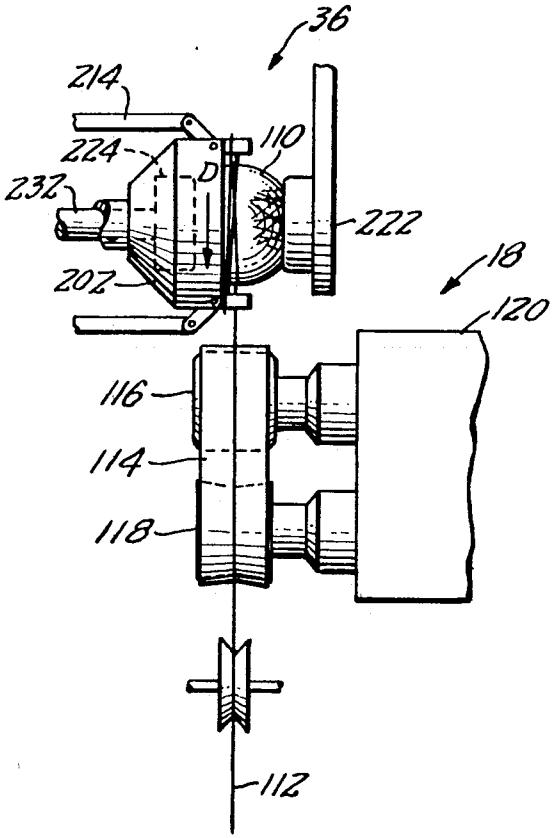
Figure 17:
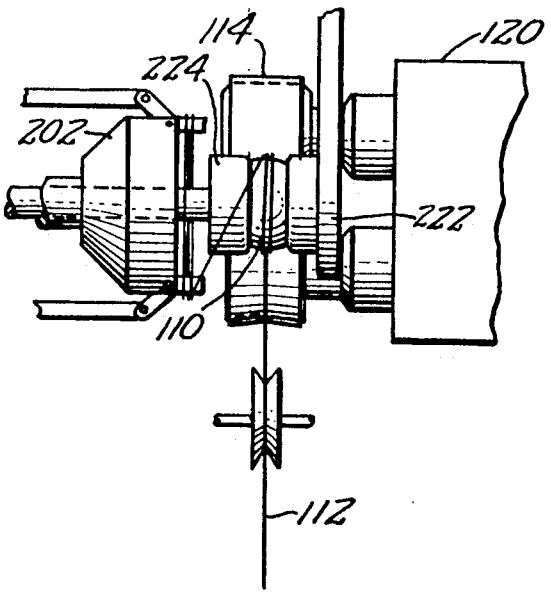

FIG. 12 illustrates the first step in severing the thread between thread supply 26 and wound center 110. Collet 202 is moved back towards wound center 110 to the same position as shown in FIG. 9 and fingers 204 are again opened as shown in FIG. 9 such that short section 206 passes through the vertical plane of thread 112. Again, spinner axis 184 is engaged such that collet 202, active grip 224, fingers 204 and wound center 110 are spun as shown in FIG. 12. Also again, hub 228 of passive grip 222 follows. This action allows fingers 204 to pick up a few turns of thread 112, preferably 2½ turns.

Figure 13:
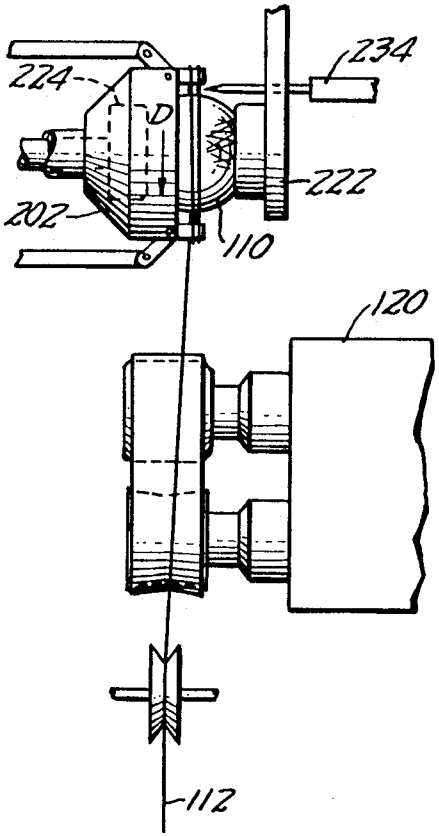

Then, collet 202 is moved across wound center 110 such that the leading edge of collet 202 moves across the center line of wound center 110, see FIG. 13. Next, spinner axis 184 is engaged such that collet 202, active grip 224, fingers 204 and wound center 110 are spun slowly. Simultaneously, hot knife 234 is activated to such a temperature that thread 112 severs before coming into actual contact with hot knife 234.

At this point, wound center 110 is severed from thread supply 26, thread 112 is held by fingers 204 due to overlap of thread 112 on short section 206 and the wound thread on wound center 110 is securely tied to the core. Next, hand 36 is moved by arm extension axis 182 such that wound center 110 is positioned directly above chute 24. Then gripper axis 190 is activated to cause both active grip 224 and passive grip 222 to release wound center 110 and drop wound center 110 into chute 24. This allows wound center 110 to pass down duct 150 to bin 152.

This finishes the steps of severing thread 112 and depositing the finished wound center 110 into the finished wound center bin 152. The next step is for hand 36 to obtain another new frozen center 110 and place it in winding machine 18.

Figure 14:
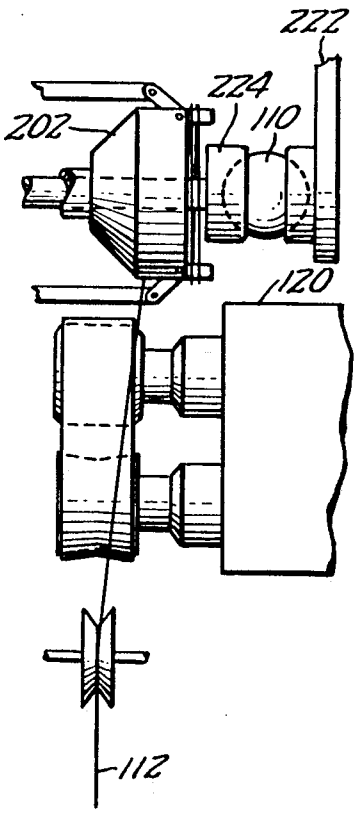

FIG. 14 illustrates hand 36 with a new frozen core in transition between cooling tower 22 and winding machine 18. As can be seen, collet 202 is still in a retracted position of FIG. 13 and center 110 is held between active and passive grips 224, 222. To pick up a new frozen center, arm 28 moves hand 36 over to cooling tower 22. At cooling tower 22, passive grip 222 pushes pin 143 which causes feed device 136 to rotate clockwise thus allowing new center 110 to fall from inner well 128 into opening 140. When feed device 136 rotates counter-clockwise under the force of spring 142 back to a rest position, active and passive grips 224, 222 are closed around the new center by means of gripper axis 190. Hand 36 is then moved away from cooling tower 22 and arm 28 is rotated to place center 110 behind winding machine 18, see FIG. 15.

Figure 15:
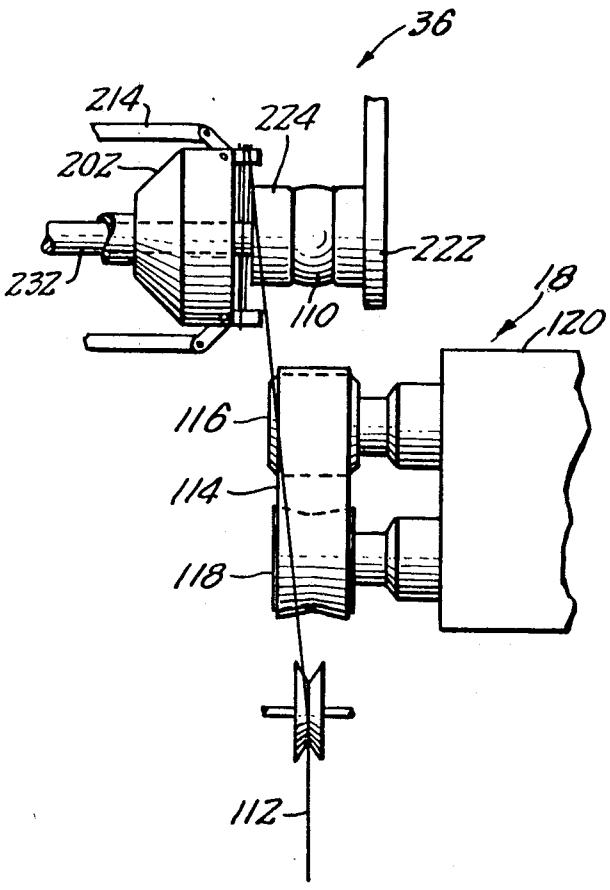

FIG. 15 shows center 110 positioned behind winding machine 18.

Figure 16:
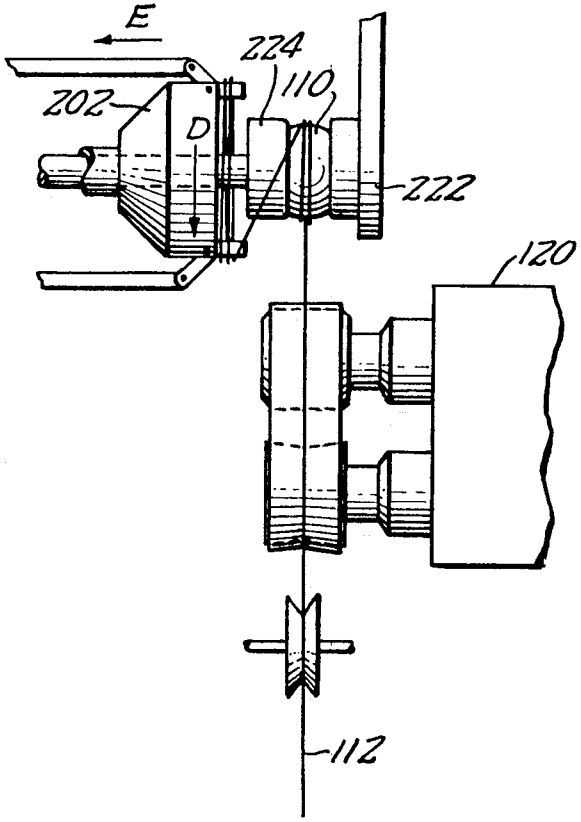

Next, collet 202 is moved to an intermediate position similar to FIG. 10, such that center 110 is now in the vertical plane of thread 112. See FIG. 16. This is done by engaging collet axis 186 and moving collet 202 closer to center 110. Spinner axis 184 is then engaged which causes collet 202, fingers 204, active grip 224 and center 110 to spin. Hub 228 of passive grip 222 follows. Just as with FIG. 10, thread 112 is wound around center 110. Prior to spinning, hand 36 moves in the direction of arrow E as shown in FIG. 16 to allow center 110 to catch thread 112. Thread 112 is wrapped a few times about center 110 by this action, preferably 3½ times.

Then, center 110 is positioned just above belt 114 by engaging arm extension axis 182. Then, winding head wheel 122 is closed down onto center 110 forcing center 110 and hand 36 down onto belt 114. This is done by engaging sensing and lifting station 126 to lower wheel 122. See FIG. 17.

Figure 18:
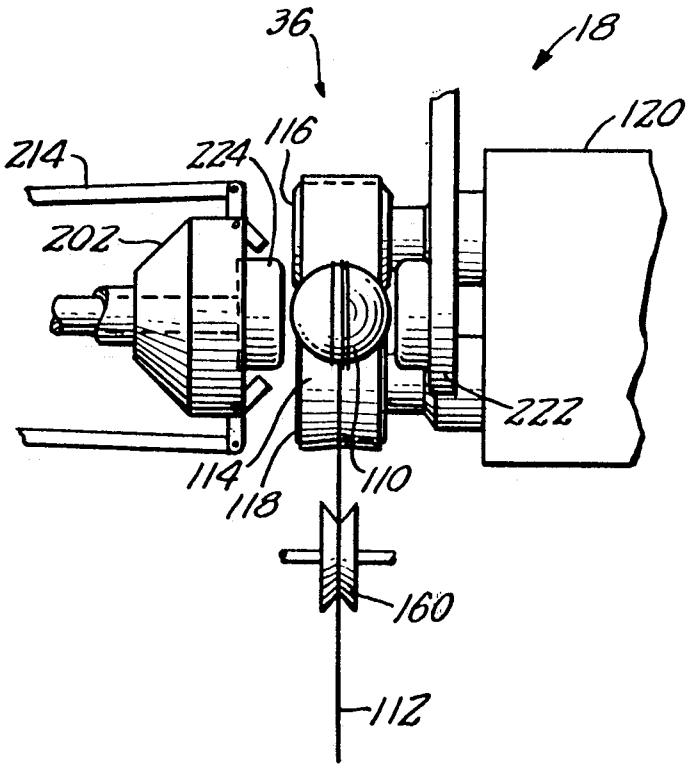

Then, active and passive grips 224, 222 are open by means of activating gripper axis 190 and winding is started by starting drive wheel 112. See FIG. 18. Simultaneously with the start of the winding operation, fingers 204 drop thread 112 as disclosed in FIG. 11 above and as shown in FIG. 18; however, in this instance, collet 202 is not moved over center 110 as is the case in FIG. 11. Dropping the thread to start the winding operation as disclosed here is preferred.

Just prior to the start of the winding operation, the thread tension is reduced by about 50% by releasing high tension wheel 164. Two to four seconds after the winding operations are started, the thread tension is returned to normal by applying wheel 164 again.

Figure 19:
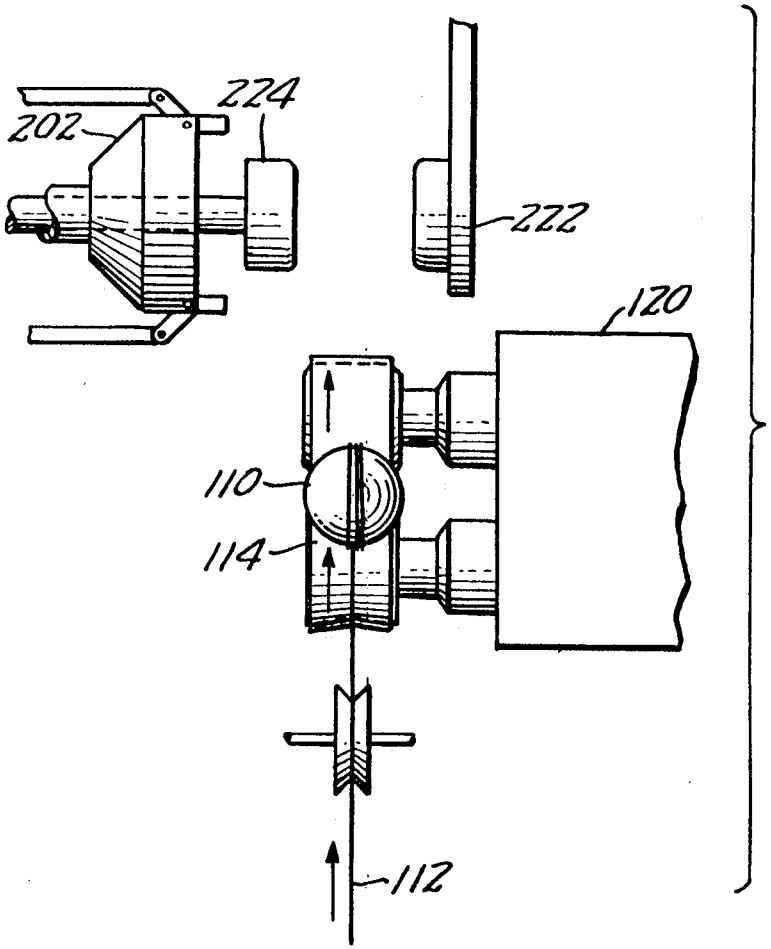

Finally, hand 36 is withdrawn by action of arm extension axis 182 and winding of center 110 continues. See FIG. 19.

Still another alternative is to allow thread 112 to break. This is accomplished by merely starting the winding operation and not dropping thread 112 off of fingers 204.

In all steps, when collet 202 is moved back and forth with respect to center 110 and is spun, fingers 204 always follow so that fingers 204 retain their relative position with respect to collet 202.

It will be understood that the claims are not limited to the preferred embodiments of the present invention herein chosen for the purpose of illustration, and that the claims are intended to cover all changes and modifications of the preferred embodiments of the present invention which do not constitute a departure from the spirit and scope of the present invention.

I claim:

1. A machine for preparing a wound golf ball core comprising:

(a) a winding station for winding thread about a golf ball center and forming a wound golf ball core, wherein said winding station comprises:

(i) a cooling means for keeping said golf ball center frozen prior to winding; and (ii) a winding means for winding thread onto said golf ball center, thereby forming said wound golf ball core; and (b) a mechanical arm for moving said golf ball center from said cooling means to said winding means, said mechanical arm having gripping means for holding the exterior of said golf ball center and also having tying means for tying the thread onto said golf ball center and tying off the thread on said wound golf ball core, wherein said tying means comprises a collet and a plurality of fingers attached to said collet.

2. A machine for producing a wound golf ball core comprising:

(a) an outer table;

(b) a plurality of cooling means mounted on said outer table, said cooling means maintaining golf ball centers in a frozen state;

(c) a plurality of winding means mounted on said outer table, one winding means per cooling means, said winding means for winding thread onto a center thereby producing a wound core;

(d) an inner table in abutment with said outer table,; and (e) a mechanical arm mounted on said inner table and able to service each and every cooling means and winding means, said mechanical arm having tying means for tying thread onto said centers, tying off the thread, and severing said wound core from said thread, said mechanical arm also having gripping means for holding the exterior of said center and core.

3. The machine of claim 2 wherein said cooling means is a cooling tower.

4. The machine of claim 3 wherein said means for manipulating is a mechanical hand.

5. A machine for producing a wound golf ball core comprising:

(a) an outer table;

(b) cooling means mounted on said outer table, said cooling means maintaining golf ball centers in a frozen state;

(c) a plurality of winding means mounted on said outer table, said winding means for winding thread onto a center thereby producing a wound core;

(d) an inner table in abutment with said outer table,; and (e) a mechanical arm mounted on said inner table and able to service each and every cooling means and winding means said mechanical arm having tying means for tying thread onto said centers, tying off the thread, and severing said wound core from said thread, said mechanical arm also having gripping means for holding the exterior of said center and core.

6. The machine of claim 5 wherein said cooling means is a cooling tower.

7. The machine of claim 6 wherein said means for manipulating is a mechanical hand.

8. A machine for preparing a wound golf ball core comprising:

(a) a winding station for winding thread about a frozen center and forming a wound golf ball core; and (b) a mechanical arm for manipulating and tying the thread onto said frozen center and for manipulating and tying off the thread on said wound golf ball core thereby preparing a wound golf ball core, wherein said tying means comprises a collet and a plurality of fingers attached to said collet.

9. The machine of claim 1 wherein said winding station comprises:

a) a cooling means for keeping a golf ball center frozen prior to winding; and b) a winding means for winding thread onto a golf ball center thereby forming a wound golf ball core, said mechanical arm moving a frozen center from said cooling means to said winding means.

10. The machine of claim 9 wherein said cooling means is a cooling tower comprising an inner well for storing said frozen center and an outer well which surrounds said inner well, the area defined between said inner well and said outer well being used for a cooling medium.

11. The machine of claim 8 wherein said cooling means is a cooling tower.

* * * * *

UNITED STATES PATENT AND TRADEMARK OFFICE

CERTIFICATE OF CORRECTION

PATENT NO. : 5,007,594

DATED : April 16, 1991

INVENTOR(S) : Robert A. Brown

It is certified that error appears in the above-identified patent and that said Letters Patent is hereby corrected as shown below:

Column 1, line 31, after "center" insert --,--.

Column 2, line 47, change "6-9" to --6-19--.

Column 3, line 9, change "6-9" to --6-19--.

Column 4, line 9, after "machine 18" insert --,--.

Column 6, line 33, change "6-18" to --6-19--.

Column 6, line 35, change "6-18" to --6-19--.

Column 7, line 17, change "a" to --as--.

Column 9, line 40, after "table" delete ",".

Column 10, line 12, after "table" delete ",".

Column 10, line 16, after "means" insert --,--.

Column 10, line 36, change "claim 1" to --claim 8--.

Signed and Sealed this

Thirteenth Day of October, 1992

*Attest:*

DOUGLAS B. COMER

*Attesting Officer*

*Acting Commissioner of Patents and Trademarks*